US008146196B2

(12) United States Patent
Seo

(10) Patent No.: US 8,146,196 B2
(45) Date of Patent: Apr. 3, 2012

(54) DEVICE WITH ROTATABLE AND ADJUSTABLE CLEANING MEMBERS FOR CLEANING THE INTERIOR OF PIPES

(75) Inventor: Sangyoung Seo, Gyeonggi-do (KR)

(73) Assignee: KMC Robotics Co., Ltd., Daejeon (KR)

( * ) Notice: Subject to any disclaimer, the term of this patent is extended or adjusted under 35 U.S.C. 154(b) by 987 days.

(21) Appl. No.: 12/124,875

(22) Filed: May 21, 2008

(65) Prior Publication Data

US 2009/0044352 A1 Feb. 19, 2009

(51) Int. Cl.

| | |
|---|---|
| ***B08B 9/02*** | (2006.01) |
| ***B08B 9/027*** | (2006.01) |
| ***B08B 9/047*** | (2006.01) |
| ***B08B 9/051*** | (2006.01) |
| ***B08B 9/04*** | (2006.01) |

(52) U.S. Cl. ..... 15/104.16; 15/104.05; 15/104.09; 15/104.31

(58) Field of Classification Search ..... 15/104.05, 15/104.061, 104.062, 104.09, 104.095, 104.11–104.16, 15/104.31; 166/170, 173–175, 177.3, 177.7; 134/8

See application file for complete search history.

(56) References Cited

U.S. PATENT DOCUMENTS

| | | | | |
|---|---|---|---|---|
| 3,525,111 | A * | 8/1970 | Von Arx | 15/104.061 |
| 4,027,349 | A * | 6/1977 | Clavin | 15/104.12 |
| 5,377,381 | A * | 1/1995 | Wilson | 15/304 |
| 5,416,944 | A * | 5/1995 | Eriksson | 15/104.09 |
| 6,128,799 | A | 10/2000 | Nagata et al. | |

FOREIGN PATENT DOCUMENTS

| | | | |
|---|---|---|---|
| JP | 07100451 | A * | 4/1995 |
| KR | 10-2007-0065118 | | 6/2007 |

* cited by examiner

*Primary Examiner* — Joseph J Hail
*Assistant Examiner* — Tyrone Hall, Jr.
(74) *Attorney, Agent, or Firm* — Dickstein Shapiro LLP

(57) ABSTRACT

A machine for pipe maintenance, which travels forward through a pipeline and effectively removes foreign substances sticking to the inside of a pipeline, using friction members 70 that are moved along the inside of the pipeline by a rotator assembly 30 and rotated by rotating shaft assemblies 50, which come in contact with the inside of the pipeline is disclosed. Further, rotating shaft assemblies 50 and a rotator assembly 30 are respectively rotated by first and second rotating units 40, 60, such that it is possible to maximize the effect of removing foreign substances in the pipeline by smoothly rotating the friction members 70, and also improve durability by preventing an erroneous operation and damage due to load that is applied during the operation.

13 Claims, 12 Drawing Sheets

DEVICE WITH ROTATABLE AND ADJUSTABLE CLEANING MEMBERS FOR CLEANING THE INTERIOR OF PIPES

BACKGROUND OF THE INVENTION

1. Field of the Invention

The present invention relates to a machine for pipe maintenance, particularly a machine that facilitates repair and maintenance of water supply and drain pipes placed under the ground by removing foreign substances sticking to the inside of the pipelines.

2. Description of the Related Art

In general, water supply and drain pipes, used to supply water to buildings, such as a house, a commercial building, and a factory, and drain used water from the buildings, are generally under the ground and connected to water supply facilities for supplying water or sewage facilities for treating drained water.

The water supply pipe is a pipe for supplying water into a building as described above, but has a problem in that rust or other foreign substances stick to the inside of the pipelines after the pipes have been under the ground over a long period of time, causing contaminated water to be supplied into the building.

Further, the drain pipe is a pipe for draining sewage used in the building and transporting water to sewage facilities, which also has a problem in that dregs contained in the sewage stick to the inside of the pipelines, such that it is difficult to drain sewage, if in excess, the pipelines are blocked and the sewage cannot be drained and flows backward into the building.

The water supply and drain pipes are currently maintained by periodically putting a self-propelled car equipped with a camera into the pipelines to check the conditions inside the pipelines and then, when a pipe having the inside condition worse than a predetermined reference is found, digging the ground and replacing the pipe that is in bad condition.

According to this method of maintaining the water supply and drain pipes, since it is required to dig the ground and then replace the pipe, not only does this cause high cost to replace the pipe but also obstructs the traffic due to a long construction period. Further, because water supply should be stopped, this inconveniences the residents of the building.

According to a self-propelled car disclosed in Korean Utility Model Registration No. 2003647470000, titled "Self-Propelled Car for Polishing Pipe", a self-propelled car 1 includes a body 2 equipped with a camera 2*a* at the upper portion of the front and wheels 2*c* that are driven by a driving motor 2*b* at the lower portion of the body 2. The self-propelled car 1 further includes a rotating part 3, a polishing part 4, supporting part 5, and a jet part 6. A rotary motor 3*a* is provided at the front portion in the body 2, a rotating shaft 3*b* of the rotary motor 3*a* is provided frontward to rotate a sprocket 3*c* and a power transmission 3*d*, and a rotating boss 3*e* is provided at the front to support the rotating shaft 3*a*. The polishing part 4 connects a polishing roller 4*a* to a rotating link 4*b* to be driven by the power transmission 3*d* of the rotating part 3 and contacts with and polishes the inside of a pipe. The supporting part 5 has a support roller 5*a* connected to a support link 5*b* such that the upper portion of the body 2 is supported while traveling. The jet part 6 has a rotating nozzle 6*a* at a side of the camera 2*a* disposed at the front of the body 2 to jet substances polished by the polishing part 4.

According to the self-propelled car for polishing a pipe, as the body 2 equipped with the camera travels in the pipeline, the polishing roller 4*a* of the polishing part 4 comes in contact with the inside of the pipeline while the camera checks the inside of the pipeline.

Further, the polishing roller 4*a* is connected to the power transmission 3*d* of the rotating part 3, such that it polishes and removes foreign substances sticking to the inside of the pipeline while rotating with the rotating link 4*b*.

Therefore, the self-propelled car for polishing a pipe was designed to reduce the cost for replacing a pipe and solve the problems, such as suspending water supply and obstructing traffic due to replacing the pipe when repairing the water supply and drain pipes, by removing foreign substances in the pipe without needing to replace the pipe in order to repair and maintain the pipe.

However, according to the self-propelled car for polishing a pipe, since the rotating link is rotated by a rotational force of one power source and the rotational force of the rotary motor is transmitted to the polishing roller to rotate the rotating roller, load exerted in the polishing roller and the rotating link that are being driven is applied to the rotary motor. As a result, the rotating link and the polishing roller cannot smoothly rotate and the efficiency of polishing was reduced, such that it was difficult to cleanly remove the foreign substances in the pipeline.

Further, the self-propelled car uses the polishing roller, of which the outside comes in contact with the inside of the pipeline, to grind and remove the foreign substances, but the contact area between the outside of the polishing roller and the inside of the pipeline is small, such that it was difficult to effectively remove the foreign substances in the pipeline.

Further, according to the self-propelled car for polishing a pipe, since the rotational directions of the rotating link and the polishing roller are the same, the polishing roller frequently slips while removing the foreign substances, such that it was difficult to effectively remove the foreign substances in the pipeline.

SUMMARY OF THE INVENTION

An object of the invention is to provide a machine for pipe maintenance that makes it possible to repair and maintain water supply and drain pipes without needing to replace a pipe by effectively removing foreign substances sticking to the inside of the water supply and drain pipes.

A machine for pipe maintenance according to an embodiment of the invention includes: a base housing that is provided with wheels at the lower portion; a traveling unit that is disposed in the base housing and moves the base housing through a pipeline by rotating the wheels; a rotator assembly that is rotatably connected to the front of the base housing; a first rotating unit that is disposed in the base housing and rotates the rotator assembly; rotating shaft assemblies that are rotatably connected to the outer side of the rotator assembly and protrude outside at predetermined distances; a second rotating unit that is disposed in the base housing and rotates the rotating shaft assemblies; and friction members that are disposed at the ends of the rotating shaft assemblies, and grind the inside of the pipeline while contacting with the inside of the pipeline.

According to the machine of the invention, it is possible to effectively remove foreign substances sticking to the inside of a pipeline, using friction members that are moved along the inside of the pipeline by a rotator assembly and rotated by rotating shaft assemblies that which come in contact with the inside of the pipeline.

Further, rotating shaft assemblies and a rotator assembly are respectively rotated by first and second rotating units, such that it is possible to maximize the effect of removing the foreign substances in the pipeline by smoothly rotating the friction members, and also to improve durability by preventing erroneous operations and damage due to load that is applied during the operation.

Therefore, by periodically removing the foreign substances inside the pipeline during the maintenance of water supply and drain pipes, it is possible to reduce the time and cost needed to maintain the water supply and drain pipes and supply pure and sanitary water to each house or building.

BRIEF DESCRIPTION OF THE DRAWINGS

The above and other features and advantages of the present invention will become more apparent by describing in detail preferred embodiments thereof with reference to the attached drawings in which.

DESCRIPTION OF THE PREFERRED EMBODIMENTS

Hereinafter, preferred embodiments of the invention are described in detail with reference to the accompanying drawings.

Figure 1:
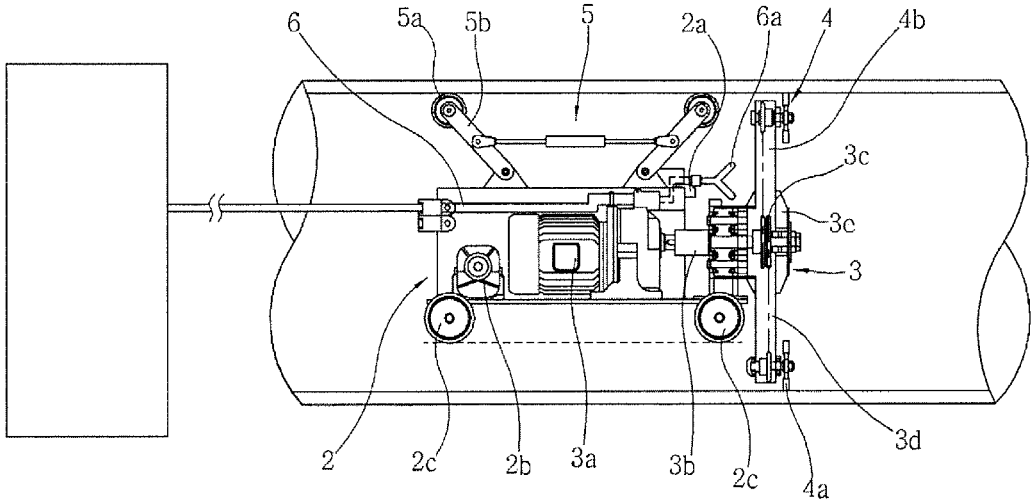
FIG.1 Prior Art
FIG. 1 is a schematic view of a self-propelled car for polishing a pipe in the related art.
Figure 2:
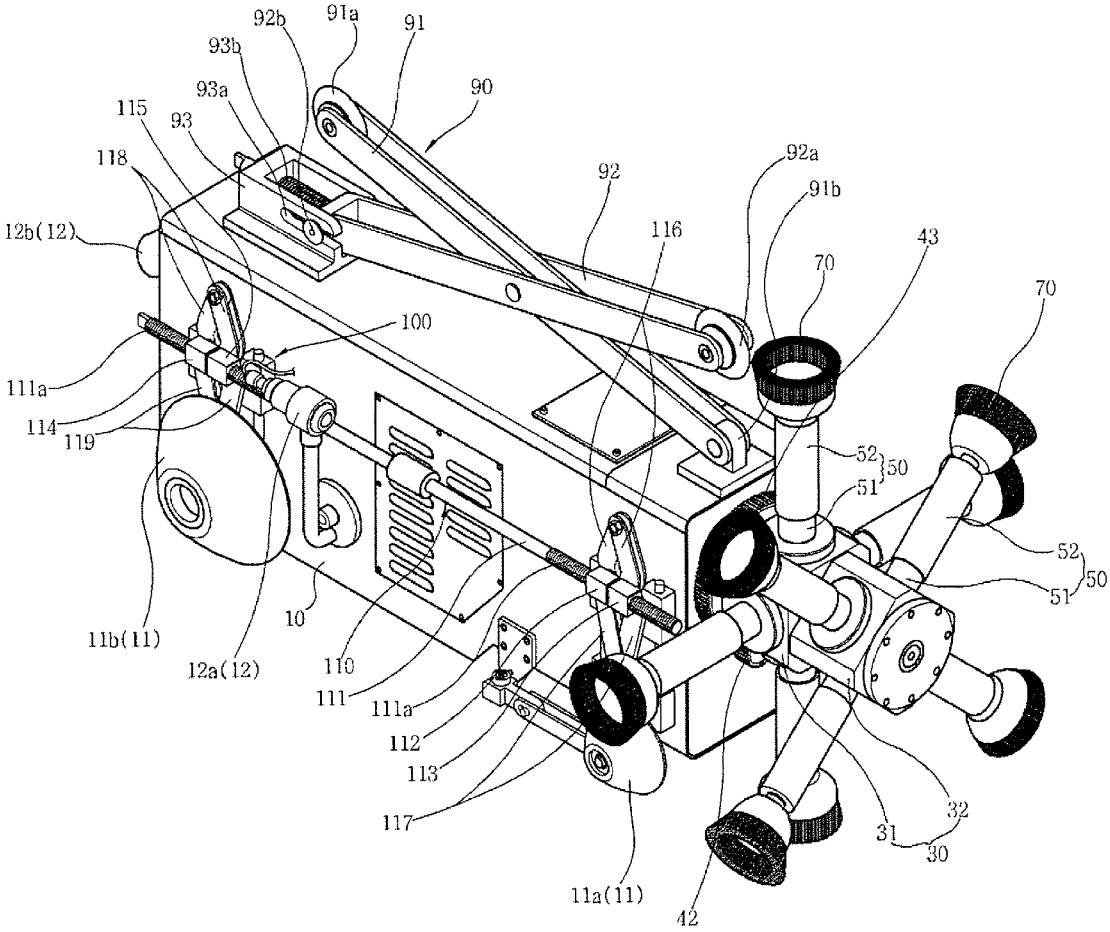
FIG. 2 is a perspective view of an embodiment of the invention.

FIG. 2 is a perspective view of an embodiment of the invention, showing the entire shape of a machine for pipe maintenance of the invention.

Figure 3:
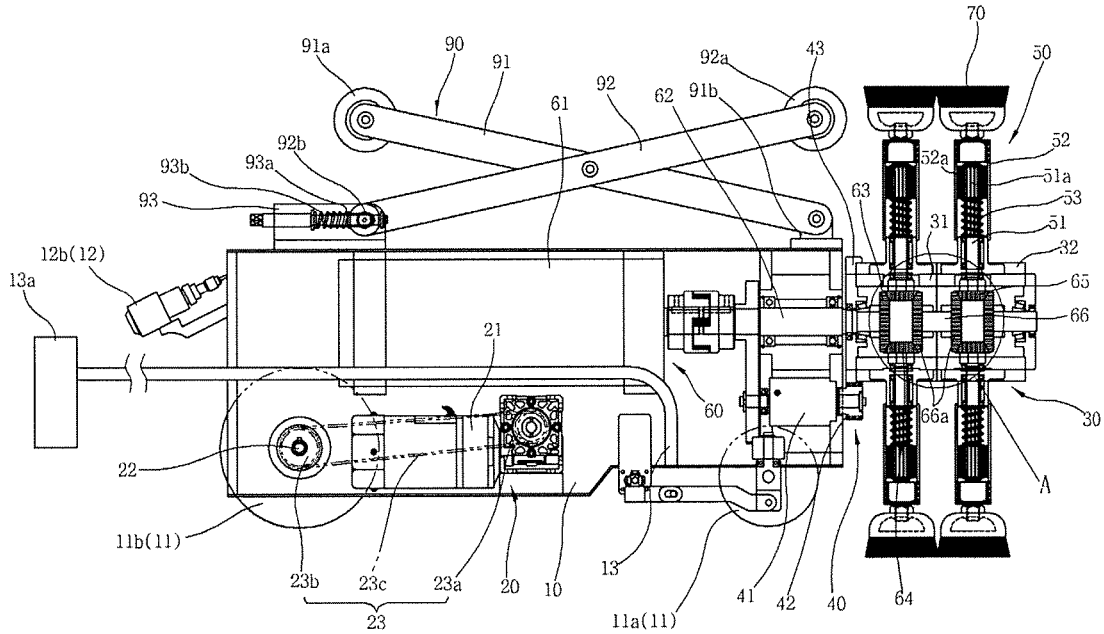
FIG. 3 is a cross-sectional view showing the internal structure of an embodiment of the invention.

FIG. 3 is a cross-sectional view showing the internal structure of an embodiment of the invention, illustrating the configuration of a base housing equipped with a traveling unit and first and second rotating units and the configuration of a rotator assembly including a power transmission gear assembly and rotating shaft assemblies.

Figure 4:
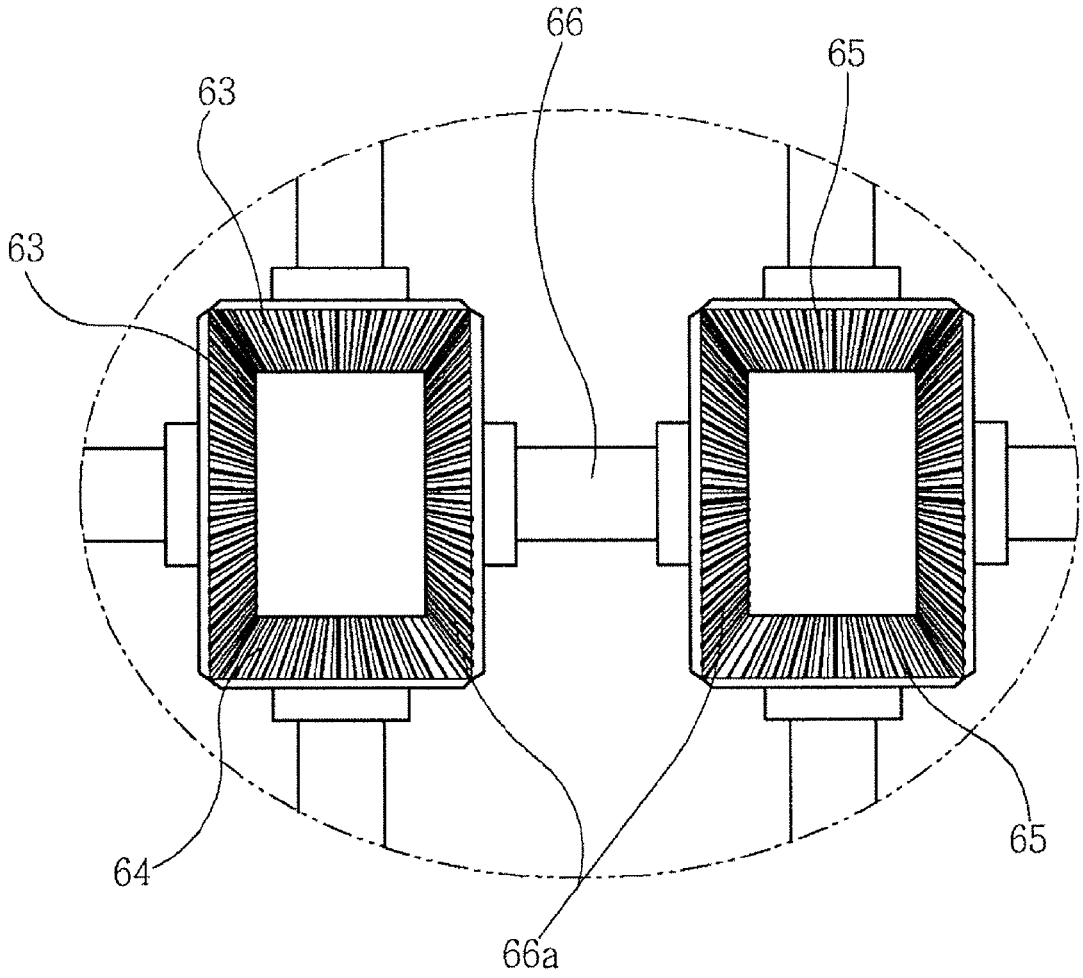
FIG. 4 is an enlarged view of the portion indicated by 'A' of FIG. 3.

FIG. 4 is an enlarged view of the portion indicated by 'A' of FIG. 3, showing the enlarged power transmission structure of the second rotating unit.

Figure 5A:
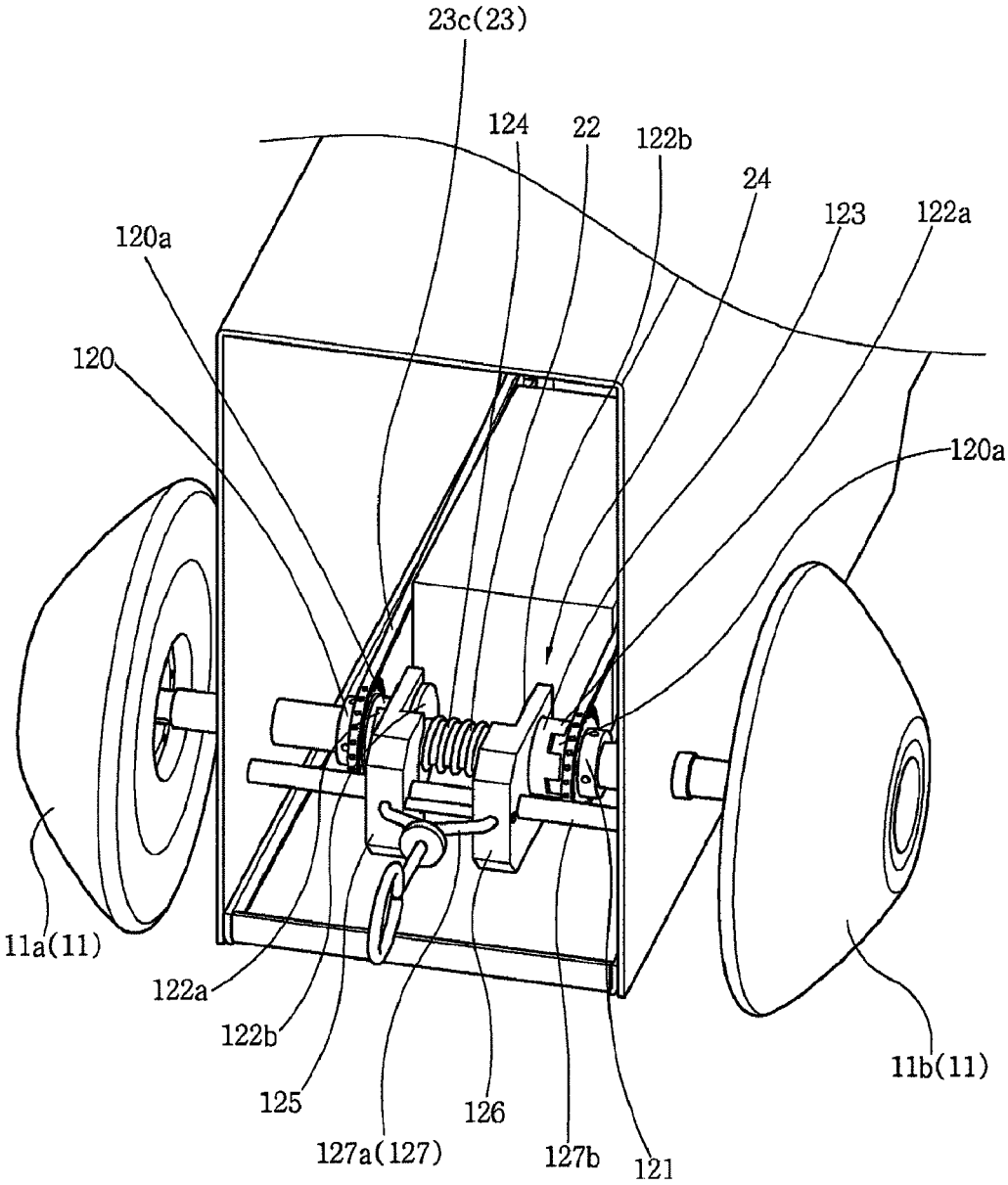
FIGS. 5A to 5C are views illustrating an exemplary use of another embodiment of the invention.
Figure 5B:
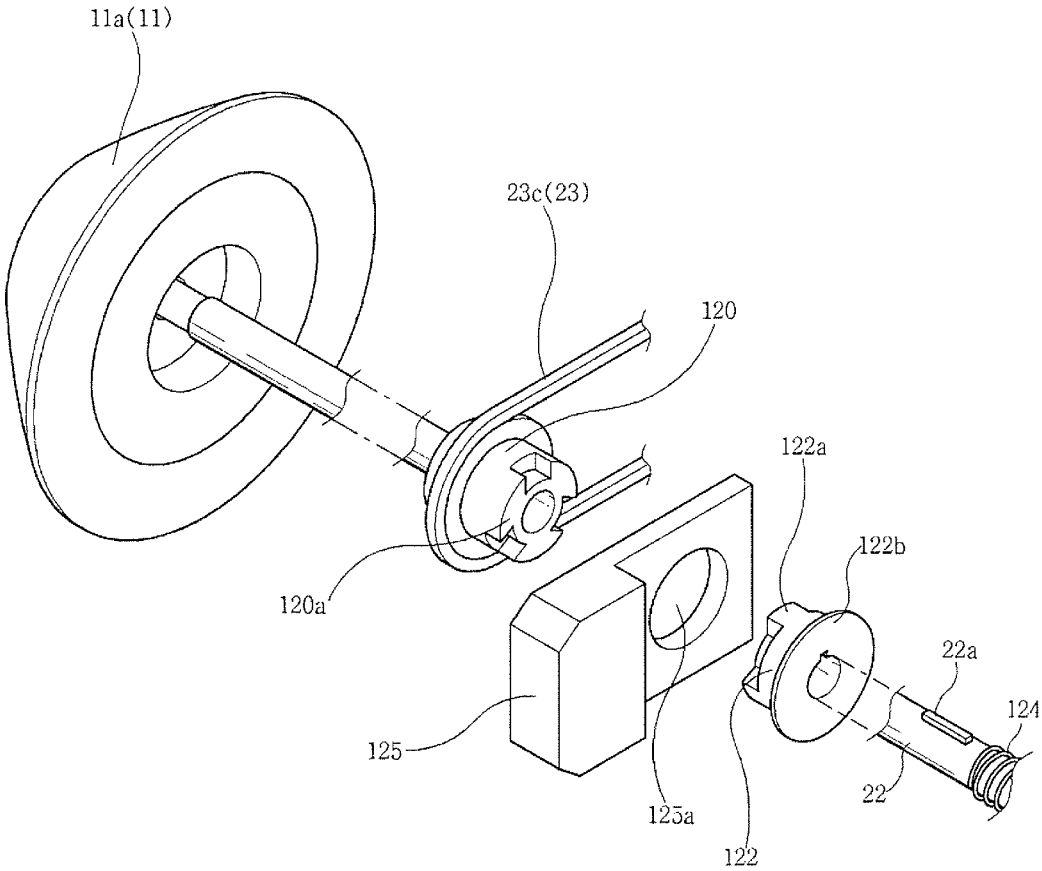
Figure 5C:
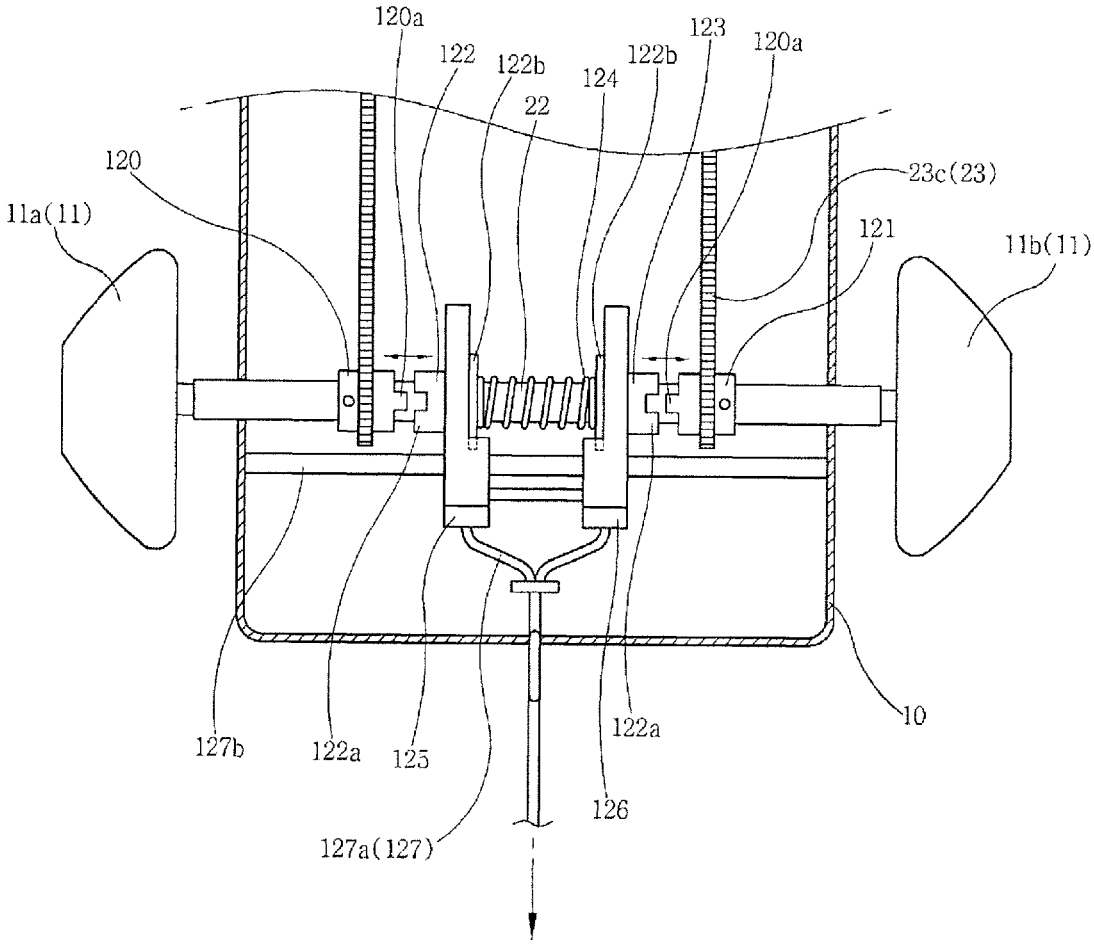

FIGS. 5A to 5C are views illustrating an exemplary use of another embodiment of the invention, illustrating the configuration and operation of an emergency control member that removes the load applied to the driving shaft when the traveling unit is broken.

Figure 6:
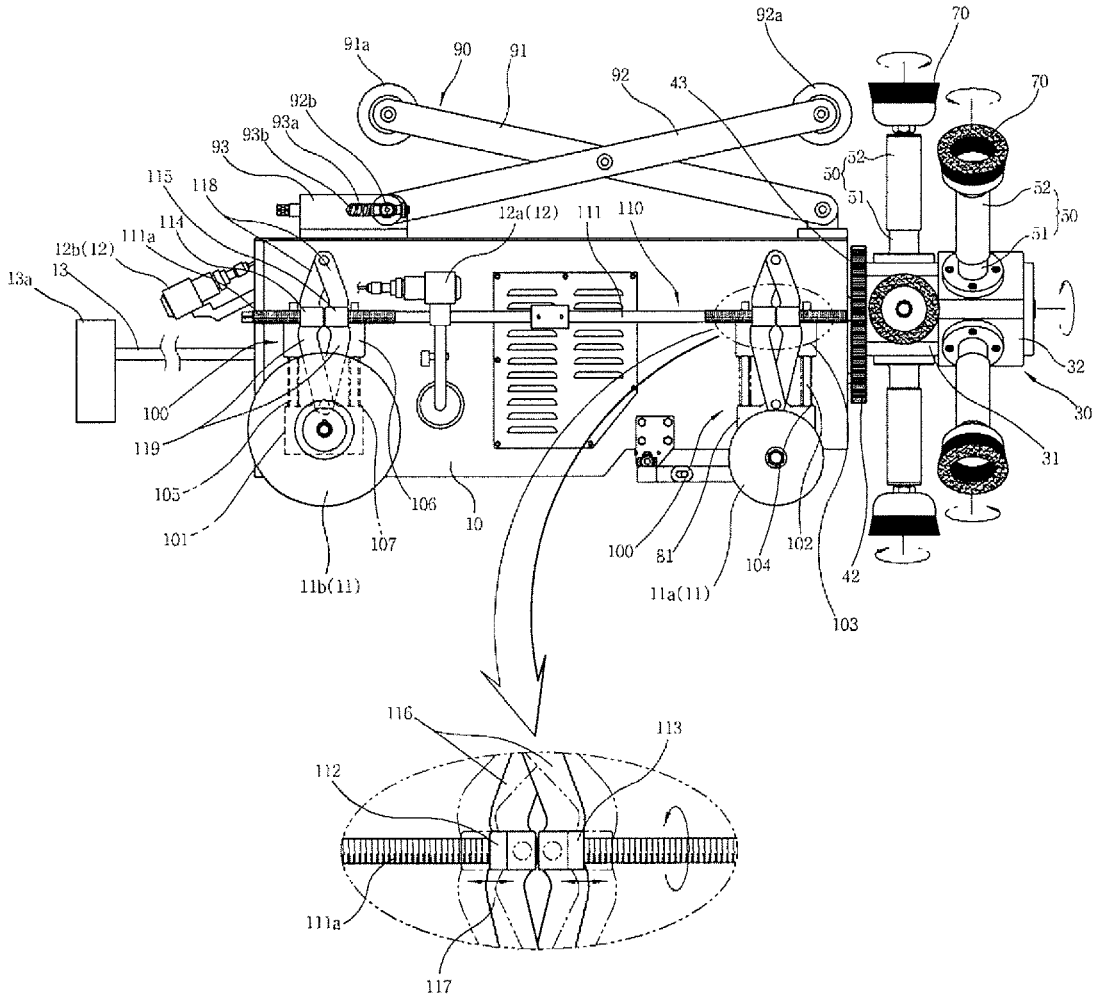
FIG. 6 is a front view of an embodiment of the invention.

FIG. 6 is a front view of an embodiment of the invention, illustrating a structure of a steering unit provided to the front wheels.

Figure 7:
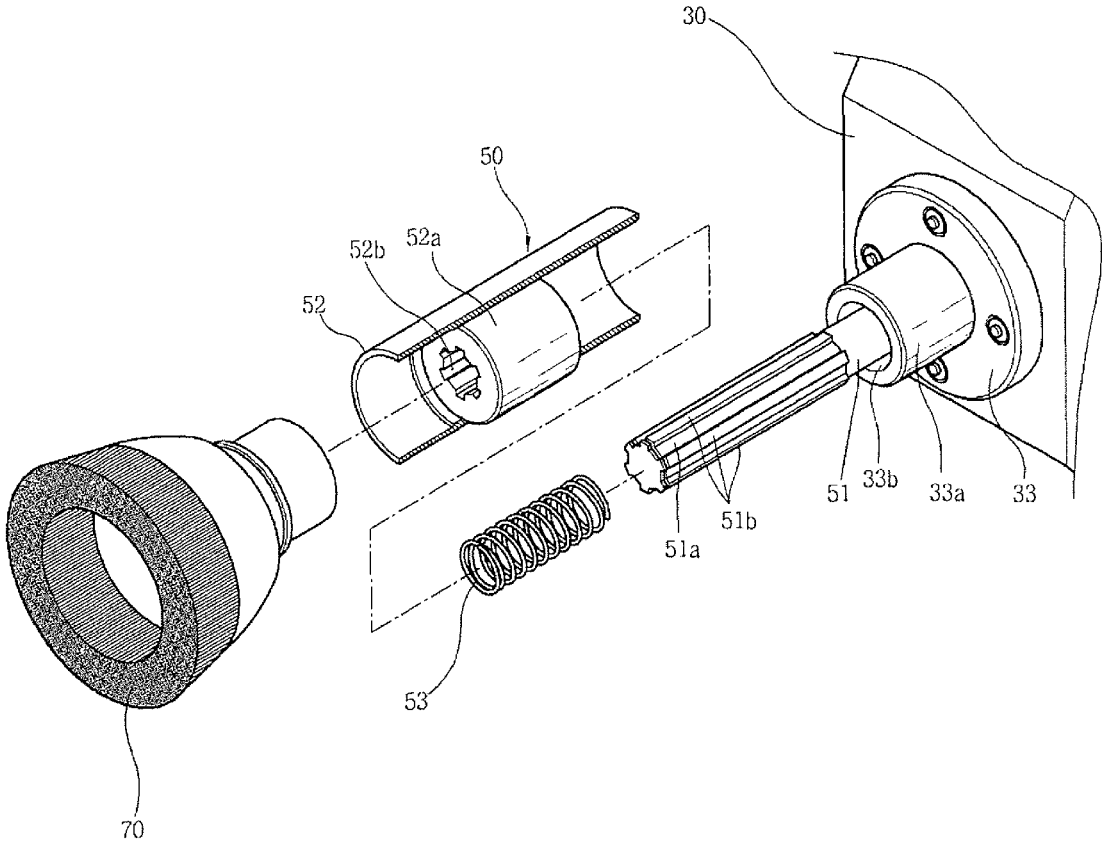
FIG. 7 is a side view of an embodiment of the invention.

FIG. 7 is a side view of an embodiment of the invention, illustrating a structure that adjusts the height of the base housing such that the centers of a pipe and the rotator assembly are aligned in the pipe according to the diameter of the pipe.

Figure 8:
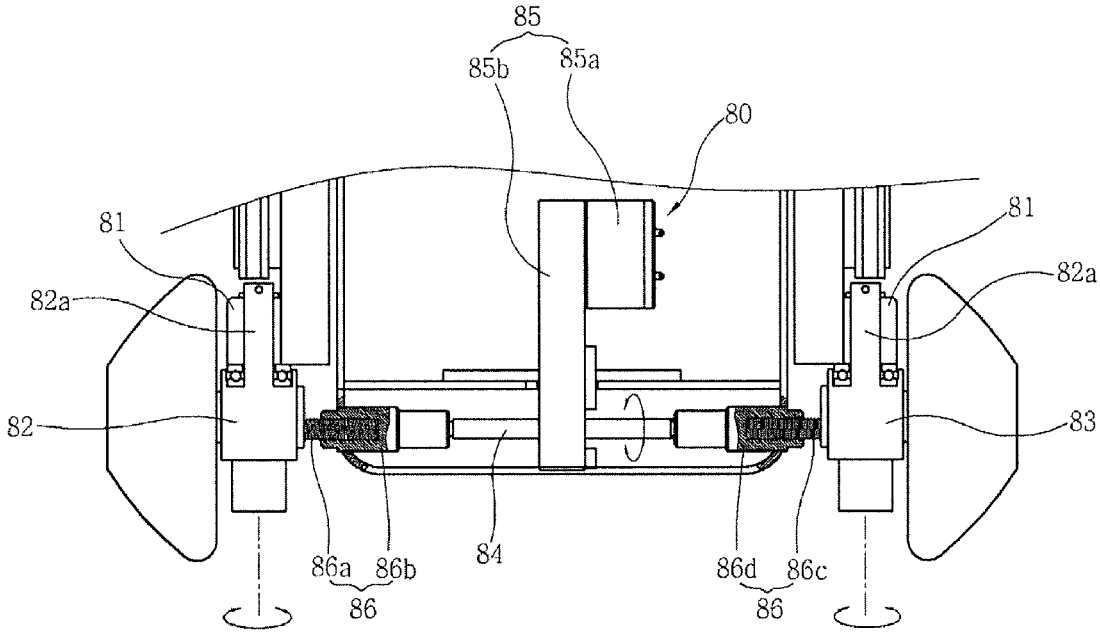
FIG. 8 is an exploded perspective view of an embodiment of the invention.

FIG. 8 is an exploded perspective view of an embodiment of the invention, showing a rotating shaft unit, which is exploded, of the invention.

Figure 9A:
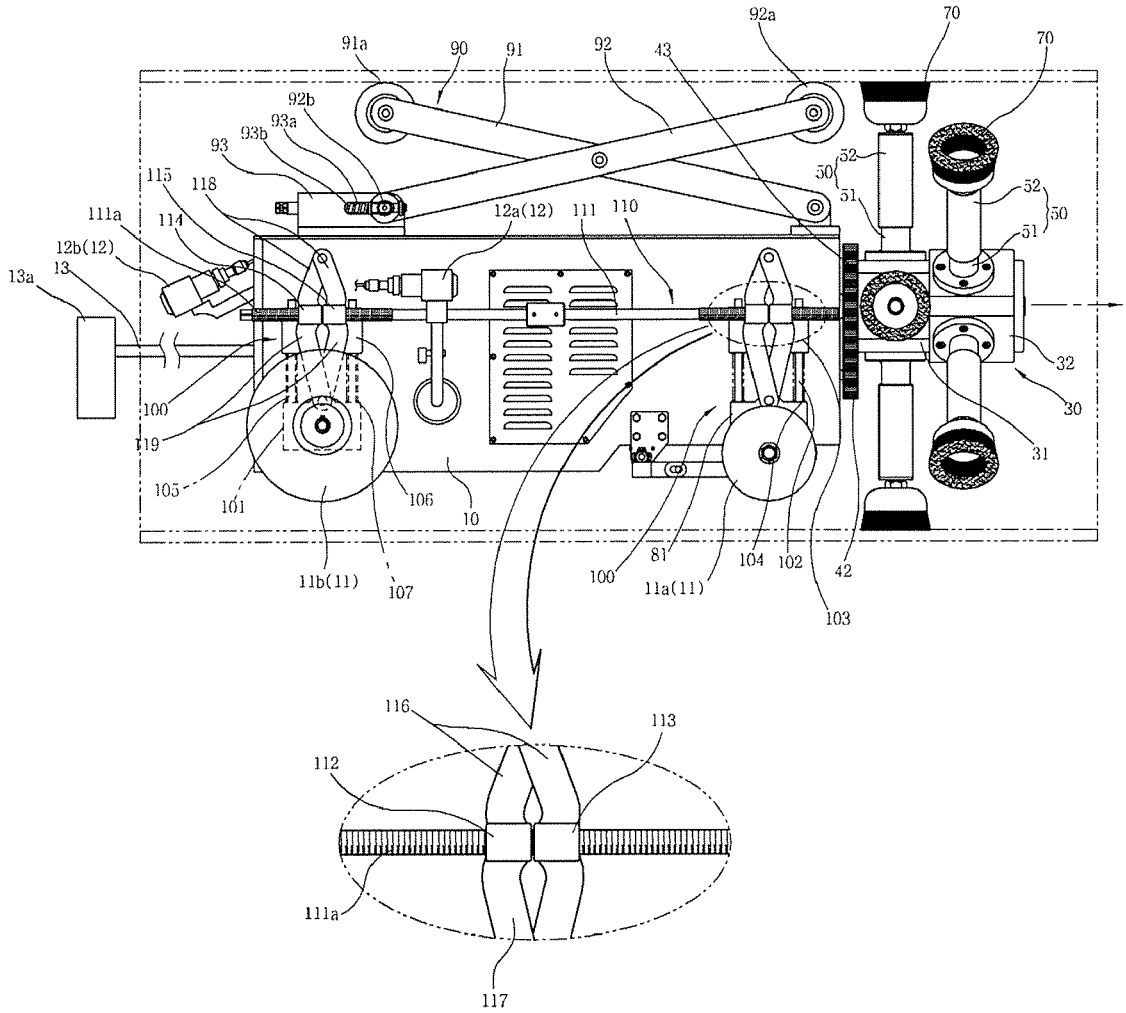
FIGS. 9A and 9B are views illustrating an exemplary use of an embodiment of the invention.
Figure 9B:
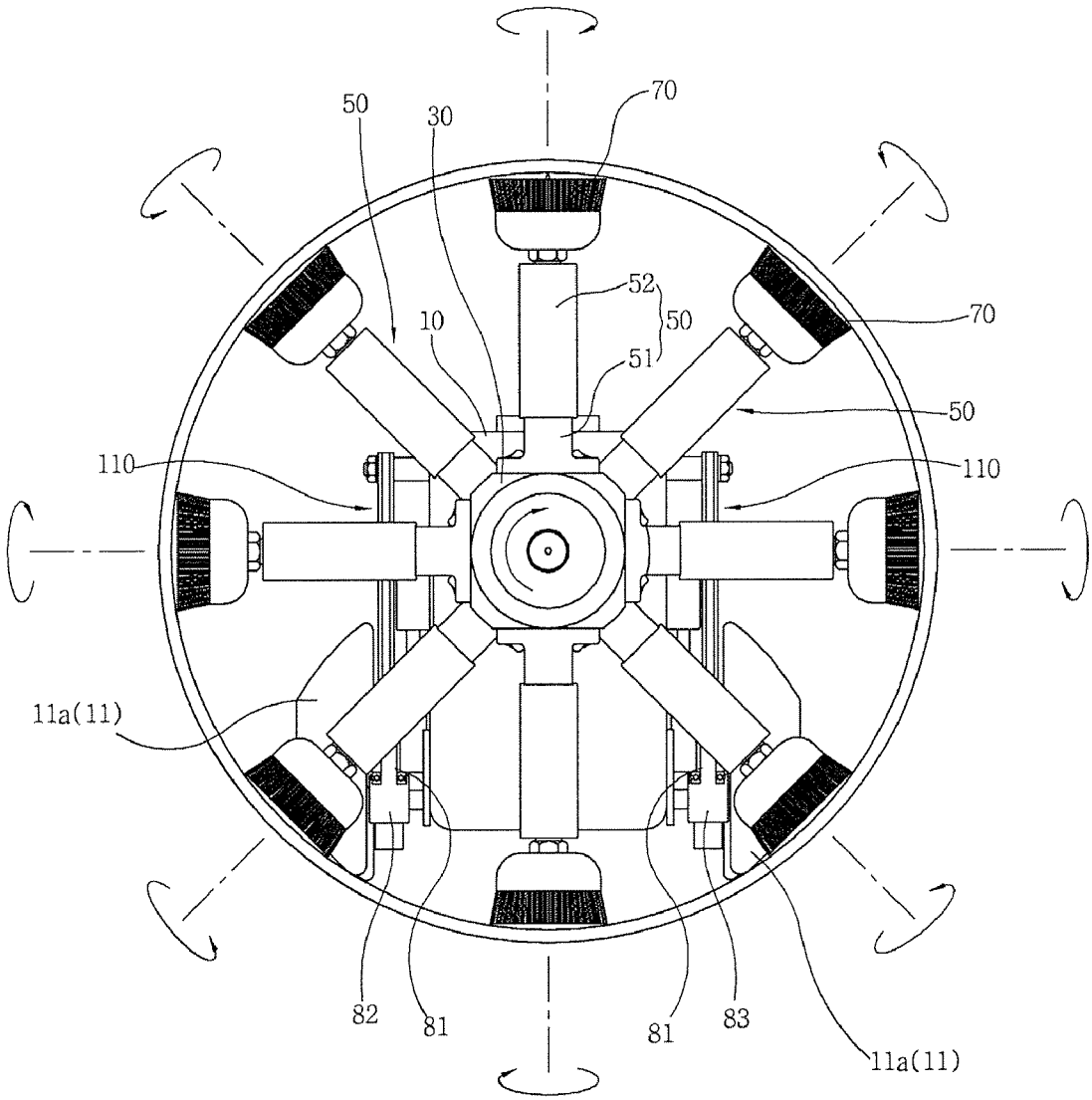

FIGS. 9A and 9B are views illustrating an exemplary use of an embodiment of the invention, illustrating an example of traveling through a pipeline, with friction members contacting with the inside of the pipeline, seen from the side and front, respectively.

As shown in FIGS. 2 and 3, the base housing 10 of a machine for pipe maintenance of the invention is provided with wheels 11, which rotate in contact with the inside of a pipeline, at the lower portion, and has a space for disposing a traveling unit 20, first and second rotating units 40, 60, and an air intake hose 13, which are described below.

It is preferable that the base housing 10 is equipped with a monitoring camera 12 that detects the inside of a pipeline while the machine travels.

The monitoring camera 12 includes front-monitoring cameras 12*a* attached to both outsides of the base housing 10 and a rear-monitoring camera 12*b* attached to the rear side.

The monitoring camera 12 is connected to a monitor provided at the outside and transmits images of the inside of the pipeline to the monitor, such that an operator that controls the machine for pipe maintenance of the invention can work safely and easily while checking the condition inside the pipeline.

Further, the monitoring camera 12 includes the front-monitoring cameras 12*a* attached to both sides and the rear-monitoring camera 12*b* attached to the rear side to monitor the rear area, such that it minimizes a blind spot in the pipeline and allows the operator to check the condition of the rear area that has been passed, in addition to checking the condition of the front area in the pipeline.

It is preferable that the monitoring camera 12 is provided with a light lamp (not shown) to light and check the dark inside of the pipeline.

Further, it is preferable that the base housing 10 is provided with an air intake hose 13 connected to an intake device 13*a*.

The intake device 13*a* basically sucks foreign substances through the air intake hose 13 under a vacuum state, and any device that can suck air through the air intake hose 13, other than the intake device 13*a*, is included in the invention.

The air intake hose 13 is disposed in the base housing 10 such that the intake faces the lower portion, through which the foreign substances grounded by the friction members 70 in the pipeline are sucked and discharged outside, and the friction members 70 are described below. Therefore, an additional work for discharging the foreign substances removed from the pipeline to the outside is not needed. Further, the grounding, removing, and sucking are simultaneously performed, such that the amount of time need to perform the work for pipe maintenance is reduced and the work efficiency is improved.

The wheels 11 include front wheels 11*a* and rear wheels 11*b* that make a pair at both left and right sides, respectively, and any one pair of the front wheels 11*a* and the rear wheels 11*b* is connected to the traveling unit 20 disposed in the base housing 10 and rotates to make the base housing 10 travel through the pipeline.

It is preferable to form the wheel 11 in a cone shape with the outside protruding and rounded with a predetermined curvature to increase the contact surface with the inside of the pipe such that the base housing 10 can smoothly travel through the pipeline.

The traveling unit 20 includes a first rotary motor 21 that is supplied with electric power and generates a rotational force, a driving shaft 22 that is fitted in the wheels 11 and rotated by the rotational force from the first rotary motor 21, and a power transmission assembly 23 that transmits the rotational force of the first rotary motor 21 to the driving shaft 22.

The power transmission assembly 23 includes a first sprocket 23*a* that is connected to the shaft of the first rotary motor 21 and rotates, a second sprocket 23*b* that is fitted on the driving shaft 22, and chains 23*c* wound around the first and second sprockets 23*a*, 23*b*, respectively.

The left and right rear wheels 11*b* of the wheels 11 are basically fitted to both ends of the driving shaft 22.

The traveling unit 20 rotates the first sprocket 23*a* using the rotational force generated by the first rotary motor 21, the rotational force is transmitted to the second sprocket 23*b* through the chain 23*c*, and the second sprocket 23*b* rotates with the driving shaft 22. As a result, as the wheels 11, i.e. the rear wheels 11*b* rotate, the base housing 10 travels along the pipeline.

The traveling unit 20 includes an emergency control member 24 that allows the driving shaft 22 to rotate without being locked to the power transmission assembly 23 by disconnecting the driving shaft 22 from the power transmission assembly 23.

The emergency control member 24 allows the driving shaft 22 to be rotated by friction with the ground such that the base housing 10 in the pipeline can be easily drawn back outside manually, when the first rotary motor 21 breaks.

The emergency control member 24, as shown in FIGS. 5A and 5B, includes: first and second power transmission rotators 120, 121, first and second shaft rotators 122, 123, a support spring 124, first and second movement guide blocks 125, 126, and a disconnecting wire assembly 127.

The first and second power transmission rotators 120, 121 each have first engagement teeth 120*a* protruding at predetermined positions facing each other and are rotatably fitted on the driving shaft to be rotated by the power transmitted from the first rotary motor 21.

The first and second shaft rotators 122, 123 each have second engagement teeth 122*a* protruding at an end and engaged with the first engagement teeth 120*a* and a block locking flange 122*b* at the other end, and can move along the driving shaft 22 while being fitted on keys 22*a* protruding in the longitudinal direction of the driving shaft 22.

The support spring 124 is disposed between the first and second shaft rotators 122, 123 to elastically support the first and second shaft rotators 122, 123.

The first and second movement guide blocks 125, 126 each have a connection hole 125*a*, in which the first and second shaft rotators 122, 123 are rotatably fitted such that block locking portions 122*b* are locked thereto.

The disconnecting wire assembly 127 includes a wire 127*a* that connects the first and second movement guide blocks 125, 126 and extends outside such that when being pulled, it moves the first and second movement guide blocks 125, 126 toward each other to disengage the first and second engagement teeth 120*a*, 122*a*.

Further, the disconnecting wire assembly 127 preferably includes a movement guide shaft 127*b* that passes through the first and second movement guide blocks 125, 126 and has both ends fitted in the inner walls of the base housing 10.

The first and second power transmission rotators 120, 121 each has a second sprocket 23*b* where the chain 23*c* is wound.

In a normal traveling state, the rotational force of the first rotary motor 21 is transmitted to the first and second power transmission rotators 120, 121 and rotates the first and second shaft rotators 122, 123 engaged with the first and second power transmission rotators 120, 121.

The driving shaft 22 is fitted in the first and second shaft rotators 122, 123 by the keys 22*a*, such that as it rotates with the first and second shaft rotators 122, 123, the wheels 11 rotate and the base housing 10 travels along the pipeline.

On the other hand, when the first rotary motor 21 stops due to an erroneous operation or problems, the driving shaft 22 remains connected to the power transmission assembly 23 and prevented from rotating.

As a result, it is difficult to draw back outside the body of the invention due to the friction of the wheels 11 and the friction between the inside of the pipeline and the friction members 70.

When the first rotary motor 21 is broken as described above, as shown in FIG. 5C, as the wire 127*a* of the disconnecting wire assembly 127 is pulled, the first and second movement guide blocks 125, 126 push the block locking portions 122*b* of the first and second shaft rotators 122, 123, moving toward each other.

Further, as the first and second shaft rotators 122, 123 are pushed and moved with the first and second movement guide blocks 125, 126, the second engagement teeth 122*a* are disengaged from the first engagement teeth 120*a*.

When the second engagement teeth 122*a* are disengaged from the first engagement teeth 120*a*, the driving shaft 22, as described above, is unlocked from the power transmission assembly 23, i.e. the first and second power transmission rotators 120, 121, and can rotate.

Therefore, when the first rotary motor 21 is broken and the wire 127*a* is pulled, the wheels 11 are rotated by the friction with the inside of the pipeline, such that the entire friction is reduced and the base housing 10 can be easily drawn outside.

Further, when the tensile force of the wire 127*a* is removed, the first and second shaft rotators 122, 123 are returned to the initial positions due to the elastic force of the support spring 124 while the second teeth 122*a* are engaged with the first teeth 120*a*, such that the machine returns to the normal traveling state.

On the other hand, as shown in FIG. 8, a steering unit 80 is connected to the front wheels 11*a* to change the traveling direction, such that it is possible to continuously work while changing the traveling direction according to the direction of the pipeline.

The steering unit 80 includes front wheel mounting members 81, a first wheel rotation shaft member 82, a second rotational shaft member 83, a steering connecting shaft member 84, a shaft rotating assembly 85, and thread-fastening members 86.

The front wheel mounting members 81 are disposed at both front sides of the base housing 10.

The first wheel rotation shaft member 82 has a wheel rotation shaft 82*a*, which protrudes from the upper portion to be rotatably connected to the lower portion of the front wheel mounting member 81, and the left front wheel 11*a* is rotatably connected to a side of the first wheel rotation shaft member 82.

The second wheel rotation shaft member 83 has a wheel rotation shaft 82*a* which protrudes from the upper portion to be rotatably connected to the lower portion of the front wheel mounting member 81, and the right front wheel 11*b* is rotatably connected to a side of the second wheel rotation shaft member 83.

The steering connection shaft member 84 has both ends connected to the first and second wheel rotation shaft members 82, 83, respectively.

The shaft rotating assembly 85 rotates the steering connection shaft member 84.

The thread-fastening members 86 are disposed at both ends of the steering connection shaft member 84 for thread-fastening of the first and second wheel rotation shaft members 82, 83.

The shaft rotating assembly 85 includes a steering-rotary motor 85*a* that generates a rotational force and can rotate in normal/reverse direction and a gear box 85*b* that rotates the steering connection shaft member 84 about the axis by transmitting the rotational force generated by the steering-rotary motor 85*a* to the steering connection shaft member 84.

The thread-fastening member 86 includes a first shaft rotation male threaded-portion 86*a*, a first shaft rotation female threaded-portion 86*b*, a second shaft rotation male threaded-portion 86*c*, and a second shaft rotation female threaded-portion 86*d*.

The first shaft rotation male threaded-portion 86*a* protrudes from the inner side of the first wheel rotation shaft member 82.

The first shaft rotation female threaded-portion 86*b* is provided at an end of the steering connection shaft member 84 and has threads that are thread-fastened to the first shaft rotation male threaded-portion 86*a*.

The second shaft rotation male threaded-portion 86*c* protrudes from the inner side of the second wheel rotation shaft member 83 and has threads that are formed in the same direction as those of the first shaft rotation male threaded-portion 86*a*.

The second shaft rotation female threaded-portion 86*d* is provided at an end of the steering connection shaft member 84 and has threads that are thread-fastened to the second shaft rotation male threaded-portion 86*c*.

The steering unit 80 operates as follows, and basically, it is assumed herein that the steering unit 80 steers in the left turn direction when the steering-rotary motor 85*a* rotates in the normal direction, and steers in the right turn direction when the steering-rotary motor 85*a* rotates in the reverse direction.

When the steering-rotary motor 85*a* rotates in the normal direction, the first shaft rotation male threaded-portion 86*a* is tightened into the first shaft rotation female threaded-portion 86*b* and pulls the first wheel rotation shaft member 82 to the inside such that the base housing 10 turns left.

Further, since the second shaft rotation male threaded-portion 86*c* has the same threads as those of the first shaft rotation male threaded-portion 86*a* and is inserted in the second shaft rotation female threaded-portion 86*d* at the opposite side, it pushes the second wheel rotation shaft member 83 to the outside while loosening from the second shaft rotation female threaded-portion 86*d* such that the base housing 10 turns left.

Further, when the steering-rotary motor 85*a* rotates in the reverse direction, the first and second shaft rotation male threaded-portions 86*a*, 86*c* operates in the opposite way to the above, that is, pushes the first wheel rotation shaft member 82 to the outside and pulls the second wheel rotation shaft member 83 to the inside, respectively, such that the base housing 10 turns right.

The steering-rotary motor 85*a* is controlled by a controller provided at the outside to rotate in the normal/reverse direction, and basically, the operator controls the steering-rotary motor 85 while checking the inside of the pipe through the monitoring camera 12. Further, it is preferable that the controller can control the traveling unit 20, which is included in the invention.

Meanwhile, an elastic support means 90 that comes in contact with the inside of the pipeline and elastically supports the base housing 10 is provided at the upper side of the base housing 10.

The elastic support means 90 absorbs the vibration generated from when the base housing 10 travels and the friction members 70, which is described below, grind the inside of the pipeline, such that it is possible to stably remove the foreign substances in the pipeline, and effectively remove the foreign substances.

The elastic support means 90 includes a first elastic support bar 91, a second elastic support bar 92, and an elastic support rail assembly 93.

The first elastic support bar 91 has an end hinged to a hinge fixing portion 91*b* provided on the upper side of the base housing 10 and the other end equipped with a first support roller 91*a* that rotates in contact with the inside of the pipeline.

The second elastic support bar 92 has a body hinged to the first elastic support bar 91, an end equipped with a second support roller 92*a* that rotates in contact with the inside of the pipeline, and the other end equipped with a moving portion 92*b*.

The elastic support rail assembly 93 has a movement rail groove 93*a* where the moving portion 92*b* of the second elastic support bar 92 is movably fitted, and a tension spring 93*b* that elastically supports the moving portion 92*b* fitted in the movement rail groove 93*a*.

The first and second elastic support bars 91, 92 are each composed of a pair of members that are connected to both sides of the first and second support rollers 91*a*, 92*a*, respectively, and the contact points of the first and second support rollers 91*a*, 92*a* with the inside of the pipeline are aligned with the center of the base housing 10, i.e. the rotational center of a rotator assembly 30 which is described below.

The first and second support bars 91, 92 absorb the vibration while they are elastically supported by the tension spring 93*b* and the moving portion 92*b* of the second elastic support bar 92 moves along the movement rail groove 93*a*.

As shown in FIG. 7, it is preferable to provide wheel shock-absorbing assemblies 100, which elastically supports the wheels 11, i.e. the front and rear wheels 11*b*, at the lower portion of the base housing 10.

The wheel shock-absorbing assembly 100 includes front wheel mounting members 81, rear wheel mounting members 101, first guide bars 102, first movement guide blocks 103, first shock-absorbing springs 104, second guide bars 105, second movement guide blocks 106, and second shock-absorbing springs 107.

The front wheel mounting members 81 are disposed at both front sides of the base housing 10 to rotatably mount the front wheels 11*a*.

The rear wheel mounting members 101 are disposed at both rear sides of the base housing 10 to rotatably mount the rear wheels 11*b*.

The first guide bar 102 protrudes upward from the front wheel mounting member 81.

The first movement guide block 103 is attached to the front side of the base housing 10 and the first guide bars 102 are movably connected to the first movement guide block 103.

The first shock-absorbing spring 104 is disposed around the first guide bar 102 and has both ends supporting the first movement guide block 103 and the front wheel mounting member 81, respectively.

The second guide bar 105 protrudes upward from the rear wheel mounting member 101.

The second movement guide block 106 is attached to the rear side of the base housing 10 and the second guide bars 105 are movably connected to the second movement guide block 106.

The second shock-absorbing spring 107 is disposed around the second guide bar 105 and has both ends supporting the second movement guide block 106 and the rear wheel mounting member 101, respectively.

The front wheels 11*a* and the rear wheels 11*b* are elastically supported by the first and second shock-absorbing springs 104, 107, respectively, while the first and second guide bars 102, 105 move in the guide blocks, such that the vibration generated from when the base housing 10 travels and the friction members 70, which are described below, grind the inside of the pipeline is absorbed.

Therefore, the vibration generated during the above operation is absorbed by the elastic support means 90 and the wheel shock-absorbing assemblies 100, such that it is possible to work stably and effectively.

On the other hand, the base housing 10 is provided wheel height adjusting assemblies 110 that make it possible to adjust the height of the wheels 11.

The wheel height adjusting assembly 110 includes the front wheel mounting members 81, the rear wheel mounting members 101, a height adjusting rotary shaft 111, first and second height adjusting nuts 112, 113, third and fourth height adjusting nuts 114, 115, a pair of first height adjusting links 116, a pair of second height adjusting links 117, a pair of third height adjusting links 118, and a pair of fourth height adjusting links 119.

The front wheel mounting members 81 are disposed at both front sides of the base housing 10 and the front wheels 11*a* are rotatably mounted to the front wheel mounting members 81.

The rear wheel mounting members 101 are disposed at both rear sides of the base housing 10 and the rear wheels 11*b* are rotatably mounted to the rear wheel mounting members 101.

The height adjusting rotary shafts 111 are rotatably fastened to the sides of the base housing 10 in the longitudinal direction of the base housing 10 and each have threaded-portions 111*a* at both end portions.

The first and second height adjusting nuts 112, 113 each have threads formed in opposite directions and are thread-fastened to the threaded-portion 111*a* at the front side of the height adjusting rotary shaft 111.

The third and fourth height adjusting nuts 114, 115 each have threads formed in opposite directions and are thread-fastened to the threaded-portion 111*a* at the rear side of the height adjusting rotary shaft 111.

The pair of first height adjusting links 116 has ends rotatably hinged to the side at the upper portion of the base housing 10 and the other ends rotatably hinged to the first and second height adjusting nuts 112, 113, respectively, by hinge shafts.

The pair of second height adjusting links 117 has ends rotatably hinged to the side at the lower portion of the base housing 10 and the other ends rotatably hinged to the first and second height adjusting nuts 112, 113, respectively, by hinge shafts of the first height adjusting links 116.

The pair of third height adjusting links 118 has ends rotatably hinged to the side of the upper portion of the base housing 10 and the other ends rotatably hinged to the third and fourth height adjusting nuts 114, 115, respectively.

The pair of fourth height adjusting links 119 has ends rotatably hinged to the side of the lower portion of the base housing 10 and the other ends rotatably hinged to the third and fourth height adjusting nuts 114, 115, respectively, by hinge shafts of the third height adjusting links 118.

Since the first and second height adjusting nuts 112, 113 are thread-fastened in opposite directions to the threaded-portion 111*a*, as the height adjusting shaft 111 rotates, they move on the threaded-portion 111*a* in opposite directions, that is, moves away from each other or toward each other.

Further, since the third and fourth height adjusting nuts 114, 115 are also thread-fastened in opposite directions to the threaded-portion 111*a*, as the height adjusting shaft 111 rotates, they move on the threaded-portion 111*a* in opposite directions, that is, move away from each other or toward each other.

As the height adjusting shaft 111 rotates, the first and second height adjusting nuts 112, 113 and the third and fourth adjusting nuts 114, 115 moves and the front and rear wheel mounting members 81, 101 ascend/descend.

In detail, as the first and second height adjusting nuts 112, 113 and the third and fourth adjusting nuts 114, 115 move away from each other, respectively, the first, second, third, and fourth height adjusting links 116, 117, 118, 119 open and the front and rear wheel mounting members 81, 101 ascend, and in contrast, as the first and second height adjusting nuts 112, 113 and the third and fourth adjusting nuts 114, 115 move toward each other, respectively, the first, second, third, and fourth height adjusting links 116, 117, 118, 119 close and the front and rear wheel mounting members 81, 101 descend. As a result, the height is adjusted.

Therefore, the height of the wheels 11 of the invention can be adjusted by adjusting the height of the front and rear wheel mounting members 81, 101, such that it is possible to work with rotational center of the rotator assembly 30, which is described below, aligned in the center of the pipeline, in accordance with the diameter of the pipeline.

On the other hand, the rotator assembly 30 is rotatably fastened to the front of the base housing 10.

The rotator assembly 30 is rotatably fitted to a base rotating shaft 62 of the second rotating unit 60, which is described below, and is preferably formed of a regular polygonal block having outsides to which the rotating shaft assemblies 50 are perpendicularly connected, radially protruding from the rotational center.

The rotator assembly 30 is rotated by the first rotating unit 40, as shown in FIG. 3, includes a second rotary motor 41 that receives electric power and generates a rotational force; a power transmission gear assembly 42 that is fitted on the motor shaft of the second rotary motor 41 and rotated; and an operational gear 43 that is provided to the rotator assembly 30 and rotates the rotator assembly 30 while being engaged and rotated with the power transmission gear 42.

Basically, a first spur gear that is fitted on the motor shaft is used as the power transmission gear 42 and a second spur gear that has teeth on the outer circumference that are engaged with teeth of the first spur gear is used as the operational gear 43 that is fixed to the rotator assembly 30.

The rotational force of the second rotary motor 41 is transmitted to the first spur gear to rotate the second spur gear, and as the second spur gear rotates, the rotator assembly 30 rotates.

The rotating shaft assemblies 50 that are perpendicularly and rotatably connected to the outer sides of the rotator assembly 30 are rotated by the second rotating unit 60.

The second rotating unit 60, as shown in FIGS. 3 and 4, includes a third rotary motor 61, a base rotating shaft 62, a first bevel gear 63, and a second bevel gear 64.

The third rotary motor 61 receives electric power and generates a rotational force.

The base rotating shaft 62 is rotated by the rotational force of the third rotary motor 61 and rotatably fitted to the center of the rotator assembly 30, protruding outside through the front of the base housing 10.

The first bevel gear 63 is fitted to the end of the base rotating shaft 62 inside the rotator assembly 30 and rotated by the rotational force of the base rotating shaft 62.

The second bevel gear 64 is fitted to the end of the rotating shaft assembly 50 inside the rotator assembly 30 and engaged and rotated with the first bevel gear 63.

The rotating shaft assembly 50 is rotated by a rotational force transmitted from the third rotary motor 61 through the first and second bevel gears 63, 64.

The rotator assembly 30 includes a first rotating part 31 with the rotating shaft assemblies 50 disposed at predetermined distances on the outside and a second rotating part 32 that protrudes forward from the first rotating part 31 and the rotating shaft assemblies 50 are disposed at predetermined distances on the outside.

The rotating shaft assemblies 50 are connected to the second rotating part 32, but are preferably disposed between the rotating shaft assemblies 50 of the first rotating part 31.

The rotator assembly 30 increases the ground area by grinding again the area, which has been ground by the rotating shaft assemblies 50 of the second rotating part 32 that rotates, using the rotating shaft assemblies 50 of the first rotating part 31 that rotates while the base housing 10 moves forward, such that efficiency of the work can be improved.

Further, to improve the efficiency of grinding, it is preferable to alternatively dispose the rotating shaft assemblies 50 of the first rotating part 31 and the rotating shaft assemblies 50 of the second rotating part 32 are alternatively disposed, that is, dispose the rotating shaft assemblies 50 of the second rotating part 32 between the rotating shaft assemblies 50 of the first rotating part 31 such that the spaces between the friction members 70 that grind the inside of the pipeline are decreased.

The second rotating unit 60 that rotates the rotator assembly 30 including the first and second rotating part 31, 32 includes the base rotating shaft 62, the first bevel gear 63, the second bevel gear 64, a third bevel gear 65, and a connecting shaft 66.

The base rotating shaft 62 protrudes through the front of the base housing 10 and is rotatably fitted to the center of the rotator assembly 30.

The first bevel gear 63 is fitted to the end of the base rotating shaft 62 inside the first rotating part 31 and rotated by the rotational force of the base rotating shaft 62.

The second bevel gear 64 is fitted to the end of the rotating shaft assembly 50, which is connected to the first rotating part 31, inside the first rotating part 31, and engaged and rotated with the first bevel gear 63.

The third bevel gear 65 is fitted to end of the rotating shaft assembly 50, which is connected to the second rotating part 32, inside the second rotating part 32.

The connecting shaft 66 has both ends equipped with fourth bevel gears 66*a* that are engaged with the second bevel gear 64 and the third bevel gear 65 and is rotatably disposed inside the first and second rotating parts 31, 32.

The rotating shaft assemblies 50 of the first rotating part 31 is rotated by the rotational force transmitted from the third rotating motor 61 through the first and second bevel gears 63, 64.

The rotating shaft assemblies 50 of the second rotating part 32 are rotated by the third bevel gear 65 engaged with the fourth bevel gear 66*a* fitted to the connecting shaft 66, which is rotated by the rotational force transmitted from the second bevel gear 64.

The friction members 70 that contact with and grind the inside of the pipeline are provided at the ends of the rotating shaft assemblies 50.

The friction member 70 may be formed of any kind of material that can remove the foreign substances on the inside of the pipeline while being in contact with the inside, such as a metal brush, an abrasive, or a cutter blade, which can be selectively mounted, depending on the conditions inside the pipeline.

It is preferable that the friction member 70 is detachably connected to the end of the rotating shaft assembly 50 such that it can be replaced according to the conditions inside the pipeline or degree of damage during work.

On the other hand, the rotating shaft assembly 50, as shown in FIGS. 3 and 7, includes a rotating shaft 51, a length adjusting shaft 52, and a shaft support spring 53.

The rotating shaft 51 is rotatably connected to the rotator assembly 30 and rotates.

The length adjusting shaft 52 is movably connected to the rotating shaft 51, rotated by a rotational force transmitted through the rotating shaft 51, and provided with the friction member 70 at the end.

The shaft support spring 53 is connected to the rotating shaft 51 and elastically supports the length adjusting shaft 52.

The second bevel gear 64 or the third bevel gear 65 is fitted to the end of the rotating shaft 51 and the rotating shaft 51 is disposed inside the rotator assembly 30.

A connecting member 51*a* with locking protrusions 51*b* on the outer circumference is connected to the other end of the rotating shaft 51.

It is preferable that the locking protrusions 51*b* are formed at predetermined intervals along the outer circumference of the connecting member 51*a* and fitted in length adjusting guides, which are described below, such that the rotational force that rotates the length adjusting shaft 52 is distributed to improve durability.

The length adjusting shaft 52 is provided with a length adjusting guide 52*a* with insertion grooves 52*b* that are formed in the longitudinal direction of the body and where the connecting member 51*a* is inserted.

The length adjusting shaft 52 is fitted on the connecting member 51*a* of the rotating shaft 51 by the insertion grooves 52*b* of the length adjusting guide 52*a*, and as the length adjusting shaft 52 longitudinally moves, the entire length of the rotating shaft assembly 50 is adjusted.

Further, even though the length adjusting shaft 52 longitudinally moves, the locking protrusions 51*b* of the connecting member 51*a* remain locked to the insertion grooves 52*b*; therefore, the length adjusting shaft 52 is rotated by the rotational force of the rotating shaft assembly 50.

Since the shaft support spring 53 elastically supports the length adjusting guide 52*a* of the length adjusting shaft 52, the friction member 70 at the end of the length adjusting shaft 52 closely contacts with the inside of the pipeline, regardless of the condition of the inside of the pipeline and absorbs vibration generated when tough foreign substances are removed during the maintenance operation.

Further, a flange 33 where the rotating shaft 51 is connected is fastened to the outside of the rotator assembly 30 such that it protrudes from the outside of the rotator assembly 30, and has a shaft fitting portion 33*a* having a shaft inserting hole 33*b* where the rotating shaft 51 is inserted.

Further, the shaft fitting portion 33*a* of the flange 33 is inserted in the length adjusting shaft 52 to guide the movement of the length adjusting shaft 52 when the length is adjusted.

The shaft support spring 53 is basically connected to the rotating shaft 51 between the shaft fitting portion 33*a* of the flange 33 and the length adjusting guide 52*a* such that both ends support the end of the shaft fitting portion 33*a* and the end of the length adjusting guide 52*a*.

That is, with the length adjusting shaft 52 elastically supported by the shaft support spring 53, the length of the rotating shaft assembly 50 is adjusted, such that it is possible to uniformly contact the friction member 70 at the end of the rotating shaft 51 to the inside of the pipeline by aligning the rotational center of the rotator assembly 30 with the center of the pipeline in accordance with the diameter of the pipeline, together with the wheel height adjusting assemblies 110.

The pipe maintenance by the above operation of the invention is performed while the machine for pipe maintenance of the invention travels through the pipeline as shown in FIGS. 9A and 9B, which is described hereafter.

An operator first places the machine for pipe maintenance of the invention inside a pipeline to be maintained, and adjusts the height of the base housing 10 according to the diameter of the pipeline by operating the height adjusting assemblies 110 such that the rotational center of the rotator assembly 30 is aligned in the center of the pipeline.

In this operation, the first and second support rollers 91*a*, 92*a* of the elastic support means 90 come in close contact with the upper portion inside the pipeline and the friction members 70 at the ends of the rotating shaft assemblies 50 come in close contact with the inside of the pipeline.

In this position, when the traveling unit 20 and the first and second rotating units 40, 60 are actuated, the body travels along the inside of the pipeline while the rotator assembly 30, i.e. the first and second rotating parts 31, 32 and the rotating shaft assemblies 50 are rotated.

The friction members 70 of the first and second rotating parts 31, 32 alternatively grind and remove the foreign substances on the inside of the pipeline by the rotation of the rotating shaft assemblies 50, moving along the inside of the pipeline by the rotation of the rotator assembly 30.

Since the vibration generated from when the base housing 10 travels and the friction members 70 grind the foreign substances is dispersed and absorbed by the elastic support means 90, the wheel shock-absorbing assemblies 100, and the shaft support springs 53 of the rotating shaft assemblies 50, an erroneous operation during the maintenance operation is prevented and the base housing 10 maximally stably travels, such that uniform maintenance can be achieved.

The foreign substance in the pipeline is ground and removed by the friction members 70, thereafter, vacuum-sucked through the intake hose and then discharged outside.

Further, it is possible to maintain the inside of the pipeline while changing the direction of the base housing 10 that is traveling, using the steering unit 80 according to the direction of the pipeline.

The operator performs maintenance while checking the inside of the pipeline through the front- and rear-monitoring cameras equipped to the base housing 10.

Further, even if the traveling unit 20 breaks during maintenance, it is possible to easily draw out the machine of the invention, which stops in the pipeline, and continue maintenance by making the driving shaft 22 freely rotate, using the emergency control member 24.

The present invention is not limited to the above embodiments and can be modified in various ways without departing from the aspect of the invention and those are included an embodiment in the present invention.

What is claimed is:

1. A machine for pipe maintenance comprising:

a base housing that is provided with wheel at the lower portion;

a traveling unit that is disposed in the base housing and moves the base housing through a pipeline by rotating the wheels;

a rotator assembly that is rotatably connected to the front of the base housing;

a first rotating unit that is disposed in the base housing and rotates the rotator assembly;

rotating shaft assemblies that are rotatably connected to the outer side of the rotator assembly and protrude outside at predetermined distances;

a second rotating unit that is disposed in the base housing and rotates the rotating shaft assemblies; and friction members that are disposed at the ends of the rotating shaft assemblies, and grind the inside of the pipeline while contacting with the inside of the pipeline, wherein the rotating shaft assembly includes:

a rotating shaft that is rotatably connected to the rotator assembly and rotates;

a length adjusting shaft that is movably connected to the rotating shaft, rotated by a rotational force transmitted through the rotating shaft, and provided with the friction member at the end; and a shaft support spring that is connected to the rotating shaft and elastically supports the length adjusting shaft.

2. The machine as set forth in claim 1, wherein the traveling unit includes:

a first rotary motor that is supplied with electric power and generates a rotational force;

a driving shaft that is fitted in the wheels and rotated by the rotational force from the first rotary motor;

a power transmission assembly that transmits the rotational force of the first rotary motor to the driving shaft; and an emergency control member that allows the driving shaft to rotate without locking to the power transmission assembly by disconnecting the driving shaft from the power transmission assembly.

3. The machine as set forth in claim 2, wherein the emergency control member includes:

first and second power transmission rotators that each have first engagement teeth protruding at predetermined positions facing each other and are rotatably fitted on the driving shaft to be rotated by power transmitted from the first rotary motor;

first and second shaft rotators that each have second engagement teeth protruding at an end and engaged with the first engagement teeth and a block locking flange at the other end, and move along the driving shaft while being fitted on keys protruding in the longitudinal direction of the driving shaft;

a support spring that is disposed between the first and second shaft rotators to elastically support the first and second shaft rotators;

first and second movement guide blocks that each have a connection hole in which the first and second shaft rotators are rotatably fitted such that block locking portions are locked thereto; and a disconnecting wire assembly that includes a wire that connects the first and second movement guide blocks and extends outside such that when being pulled, the wire moves the first and second movement guide blocks toward each other to disengage the first and second engagement teeth.

4. The machine as set forth in claim 1, wherein the base housing is provided with height adjusting assemblies that adjust the height of the wheels.

5. The machine as set forth in claim 4, wherein the height adjusting assembly includes:

front wheel mounting members that are disposed at both front sides of the base housing and where front wheels are rotatably mounted;

rear wheel mounting members that are disposed at both rear sides of the base housing and where rear wheels are rotatably mounted;

height adjusting rotary shafts that are rotatably fastened to the sides of the base housing in the longitudinal direction of the base housing and each have threaded-portions at both end portions;

first and second height adjusting nuts that each have threads formed in opposite directions and are thread-fastened to the threaded-portion at the front side of the height adjusting rotary shaft;

third and fourth height adjusting nuts that each have threads formed in opposite directions and are thread-fastened to the threaded-portion at the rear side of the height adjusting rotary shaft;

a pair of first height adjusting links that has ends rotatably hinged to the side at the upper portion of the base housing and the other ends rotatably hinged to the first and second height adjusting nuts, respectively, by hinge shafts;

a pair of second height adjusting links that has ends rotatably hinged to the side at the lower portion of the base housing and the other ends rotatably hinged to the first and second height adjusting nuts, respectively, by hinge shafts of the first height adjusting links;

a pair of third height adjusting links that has ends rotatably hinged to the side of the upper portion of the base housing and the other ends rotatably hinged to the third and fourth height adjusting nuts, respectively; and a pair of fourth height adjusting links that has ends rotatably hinged to the side of the lower portion of the base housing and the other ends rotatably hinged to the third and fourth height adjusting nuts, respectively, by hinge shafts of the third height adjusting links.

6. The machine as set forth in claim 1, wherein the second rotating unit includes:

a third rotary motor that receives electric power and generates a rotational force;

a base rotating shaft that is rotated by the rotational force of the third rotary motor and rotatably fitted to the center of the rotator assembly while protruding outside through the front of the base housing;

a first bevel gear that is fitted to the end of the base rotating shaft inside the rotator assembly and rotated by the rotational force of the base rotating shaft; and a second bevel gear that is fitted to the end of the rotating shaft assembly inside the rotator assembly and engaged and rotated with the first bevel gear.

7. The machine as set forth in claim 1, wherein the rotator assembly includes:

a first rotating part with the rotating shaft assemblies disposed at predetermined distances on the outside; and a second rotating part that protrudes forward from the first rotating part and is provided with the rotating shaft assemblies disposed at predetermined distances on the outside.

8. The machine as set forth in claim 1, wherein the second rotating unit includes:

the base rotating shaft that protrudes through the front of the base housing and is rotatably fitted to the center of the rotator assembly;

the first bevel gear that is fitted to the end of the base rotating shaft inside the first rotating part and rotated by the rotational force of the base rotating shaft;

the second bevel gear that is fitted to the end of the rotating shaft assembly, which is connected to the first rotating part, inside the first rotating part, and engaged and rotated with the first bevel gear;

a third bevel gear that is fitted to the end of the rotating shaft assembly, which is connected to the second rotating part, inside the second rotating part; and a connecting shaft that has both ends equipped with fourth bevel gears that are engaged with the second bevel gear and the third bevel gear, and is rotatably disposed inside the first and second rotating parts.

9. The machine as set forth in claim 1, wherein the base housing is equipped with monitoring cameras through which the inside of the pipeline is detected when traveling.

10. The machine as set forth in claim 1, wherein the base housing is provided with an air intake hose connected to an intake device.

11. The machine as set forth in claim 1, wherein a steering unit that changes the traveling direction is provided to the front wheels.

12. The machine as set forth in claim 1, wherein an elastic support means that contacts with the inside of the pipeline and elastically supports the base housing is provided at the upper side of the base housing.

13. The machine as set forth in claim 1, wherein the base housing is provided with wheel shock-absorbing assemblies, which elastically support the wheels, at the lower portion.

* * * * *